US011572086B2

(12) United States Patent
Fenny et al.

(10) Patent No.: US 11,572,086 B2
(45) Date of Patent: Feb. 7, 2023

(54) ELECTRIC AERIAL SKY TRAM

(71) Applicant: Bell Textron Inc., Fort Worth, TX (US)

(72) Inventors: Carlos Alexander Fenny, Fort Worth, TX (US); Guy Bernard, Kirkland (CA)

(73) Assignee: Textron Innovations Inc., Providence, RI (US)

( * ) Notice: Subject to any disclaimer, the term of this patent is extended or adjusted under 35 U.S.C. 154(b) by 420 days.

(21) Appl. No.: 16/791,108

(22) Filed: Feb. 14, 2020

(65) Prior Publication Data

US 2021/0253139 A1 Aug. 19, 2021

(51) Int. Cl.

| | |
|---|---|
| ***B61B 7/06*** | (2006.01) |
| ***B61B 12/00*** | (2006.01) |
| ***B61B 12/02*** | (2006.01) |
| ***B61B 3/02*** | (2006.01) |
| *B61B 10/02* | (2006.01) |

(52) U.S. Cl.

CPC ..... *B61B 7/06* (2013.01); *B61B 3/02* (2013.01); *B61B 12/002* (2013.01); *B61B 12/028* (2013.01); *B61B 10/022* (2013.01)

(58) Field of Classification Search

CPC .... B61B 1/02; B61B 3/00; B61B 3/02; B61B 7/00; B61B 7/06; B61B 12/002; B61B 12/02; B61B 12/04; B61B 12/026; B61B 12/028; B61B 12/022; B61B 12/12; B61B 10/02; B61B 10/022

See application file for complete search history.

(56) References Cited

U.S. PATENT DOCUMENTS 1,360,097 A * 11/1920 Davino ..... B61B 3/02 104/23.1
1,798,852 A * 3/1931 Roghmanns ..... B61B 3/02 104/23.1
1,986,845 A * 1/1935 Napier ..... B61B 13/04 105/66
2,633,054 A * 3/1953 Black ..... F16M 11/425 352/197
2,781,001 A * 2/1957 Davino ..... E01B 25/22 104/247
3,355,580 A * 11/1967 Wachs ..... B61B 12/00 362/478
3,457,876 A * 7/1969 Darwin ..... B61B 13/04 212/346

(Continued)

FOREIGN PATENT DOCUMENTS

CN 107745715 A * 3/2018 ..... B61B 3/00

OTHER PUBLICATIONS

Dark Roasted Blend; "DRB Pic of the Day: Propeller-driven 'The Bennie Railplane'"; http://www.darkroastedblend.com/2012/05/drb-pic-of-day-propeller-driven-bennie.html; dated May 18, 2012; 7 pages.

*Primary Examiner* — S. Joseph Morano
*Assistant Examiner* — Cheng Lin
(74) *Attorney, Agent, or Firm* — Shackelford, Bowen, McKinley & Norton, LLP

(57) ABSTRACT

An aerial sky tram system includes a plurality of towers, a cable track suspended from the plurality of towers by a support cable, and a sky tram coupled to the cable track. The sky tram includes a plurality of rotors that propel the sky tram along the cable track.

20 Claims, 17 Drawing Sheets

(56) References Cited

U.S. PATENT DOCUMENTS

| | | | | | |
|---|---|---|---|---|---|
| 3,774,542 | A * | 11/1973 | Walsh | B61C 11/06 | 104/93 |
| 5,901,649 | A * | 5/1999 | Hathaway | B61B 1/005 | 104/29 |
| 7,549,377 | B2 * | 6/2009 | Pabst | B61B 12/04 | 104/112 |
| 2019/0241202 | A1 * | 8/2019 | Thomas | B61L 27/16 | |

* cited by examiner

ELECTRIC AERIAL SKY TRAM

TECHNICAL FIELD

The present disclosure relates generally to a system for mass-transit and more particularly, but not by way of limitation, to an electrically powered aerial sky tram.

BACKGROUND

This section provides background information to facilitate a better understanding of the various aspects of the disclosure. It should be understood that the statements in this section of this document are to be read in this light, and not as admissions of prior art.

In undeveloped, sparsely populated areas, cars and trucks operating on surface roads provide the lowest cost and most flexible solution for transportation of people and goods. Surface railways offer an alternative to surface roads. As population density increases, available land for expanding surface road and rail networks becomes costly and more difficult to obtain. Increases in population density also lead to an increase in the number of commuters, and thus an increase in the amount of traffic that can lead to gridlock. The increase in traffic can make surface roads/railways inadequate/inefficient.

Two common attributes that are the basis for most past and new solutions to gridlock are to create infrastructure to either go above ground level (e.g., elevated trains, aerial trams, etc.) or below ground level (e.g., subways, road tunnels, etc.). While below-ground systems can be effective, they are significantly more expensive to create than above-ground systems. Below-ground systems can provide an effective solution to urban gridlock as they are essentially invisible and typically immune from the effects of weather. Below-ground systems however require incredible capital investment, carry high maintenance costs, and are limited in application by soil conditions and terrain.

Above-ground systems can be a much more cost-effective way to provide new transportation options for commuters. Unlike on-ground systems that rely on existing railway track and have to share right of way with heavy cargo trains, elevated-rail systems and vehicles are purpose-designed for mass transit. This allows above-ground systems to provide commuter trains that can operate at high speed in dense urban areas without crossing surface roads and adding to gridlock. Modern elevated-rail systems are currently operating at high speeds and autonomously in many cities. However, while the land footprint of elevated-rail systems is relatively small compared to conventional surface rail system, the infrastructure costs associated with elevated rail systems are very high. Costs are especially high if routes require passage over natural or man-made obstacles like rivers, mountains, or buildings. Elevated-rail systems can also generate a fair amount of noise as the train cars roll over the trestles. The size of the support structures required to support the rails of elevated-rail systems can be aesthetically unpleasing, which can affect public acceptance of elevated-rail systems.

SUMMARY

This summary is provided to introduce a selection of concepts that are further described below in the detailed description. This summary is not intended to identify key or essential features of the claimed subject matter, nor is it to be used as an aid in limiting the scope of the claimed subject matter.

An example of an aerial sky tram system includes a plurality of towers, a cable track suspended from the plurality of towers by a support cable, and a sky tram coupled to the cable track. The sky tram includes a plurality of rotors that propel the sky tram along the cable track.

An example of a sky tram for an aerial sky tram system includes a compartment for passengers or cargo, a truck attached to a top of the compartment and configured to couple to the sky tram to a cable track suspended from a tower, and a plurality of rotors attached to the compartment and configured to propel the sky tram along the cable track.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
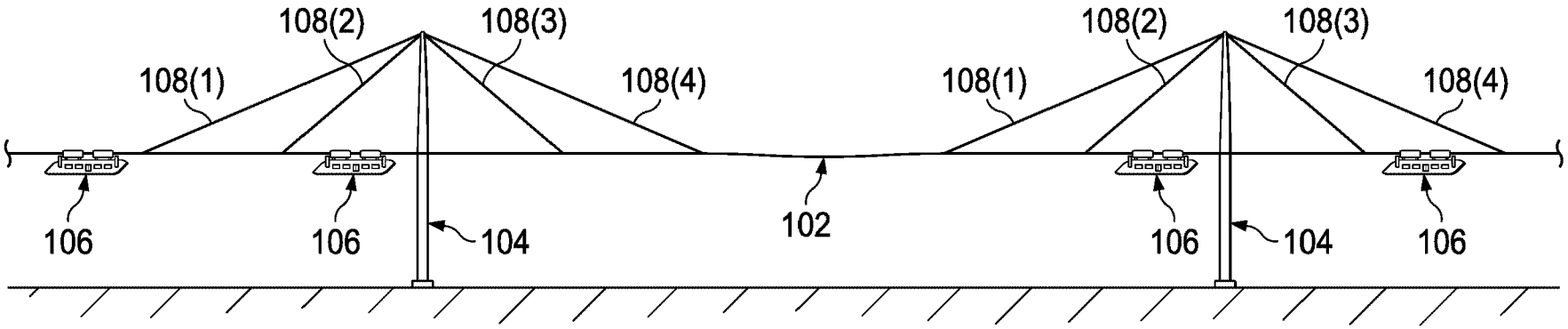
FIG. 1 is a side view of an electric aerial sky tram system, according to aspects of the disclosure.

It is to be understood that the following disclosure provides many different aspects, or examples, for implementing different features of various embodiments. Specific examples of components and arrangements are described below to simplify the disclosure. These are, of course, merely examples and are not intended to be limiting. In addition, the disclosure may repeat reference numerals and/ or letters in the various examples. This repetition is for the purpose of simplicity and clarity and does not in itself dictate a relationship between the various embodiments and/or configurations discussed.

In the specification, reference may be made to the spatial relationships between various components and to the spatial orientation of various aspects of components as the devices are depicted in the attached drawings. However, as will be recognized by those skilled in the art after a complete reading of the present disclosure, the devices, members, apparatuses, etc. described herein may be positioned in any desired orientation. Thus, the use of terms such as "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

An alternative above-ground option to the elevated-rail system is an aerial-tram system (e.g., gondola systems). Aerial-tram systems offer several advantages over below-ground systems and elevated-rail systems. Modern aerial-tram systems use moving cables that are supported by towers to convey gondolas or cars with up to 200 passengers per car. In some applications, these systems can transport up to 6,000 persons per hour. Aerial-tram systems can typically be constructed at a fraction of the cost of below-ground systems and elevated-rail systems. Environmental impacts of aerial-tram systems, including energy consumption and noise, are minimal.

Compared to the infrastructure required for elevated-rail systems, aerial-tram systems utilize a smaller footprint, which facilitates incorporation into already congested environments. Additionally, cable support towers for aerial-tram systems may be spaced apart as much as 1.2 miles, which not only minimizes the number of towers required, but also allows traversing large bodies of water or other obstacles without costly bridges or tunnels. Comparatively, support structures for elevated-rail systems must be placed much closer together, which greatly increases costs and limits placement. Aerial-tram systems do carry the disadvantage of much lower speeds compared to other mass-transit systems (e.g., some aerial trams cannot exceed speeds of 30 MPH). Another limitation of aerial-tram systems is that the routes are limited to straight-line segments without the addition of concrete or steel guideways. Additionally, high winds and bad weather can force shut downs that would not occur with ground-based technologies.

The present disclosure is directed to an electric aerial sky tram system that overcomes the disadvantages of other forms of mass transit. Among the benefits of the electrical aerial sky tram of the instant disclosure are: low infrastructure cost, small footprint for use in dense urban areas, low total operating cost per passenger mile, short passenger travels times due to high-speed capabilities (speeds up to 160 MPH), long range capabilities, large volume of passengers per hour, high system up-time, increased safety, low environmental impact, and broad public accessibility.

Figure 2:
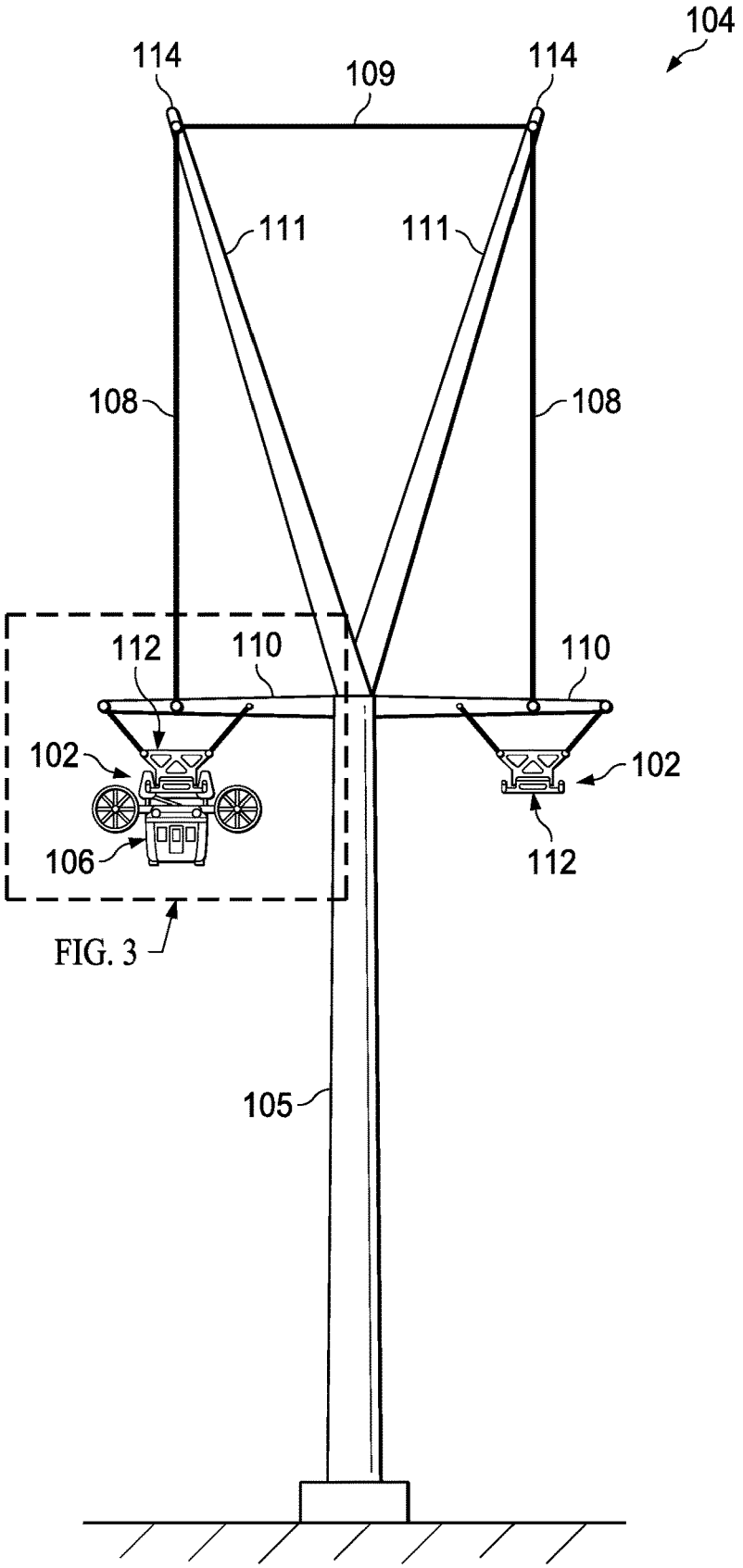
FIG. 2 is a front view of the electric aerial sky tram system of FIG. 1, according to aspects of the disclosure.
Figure 3:
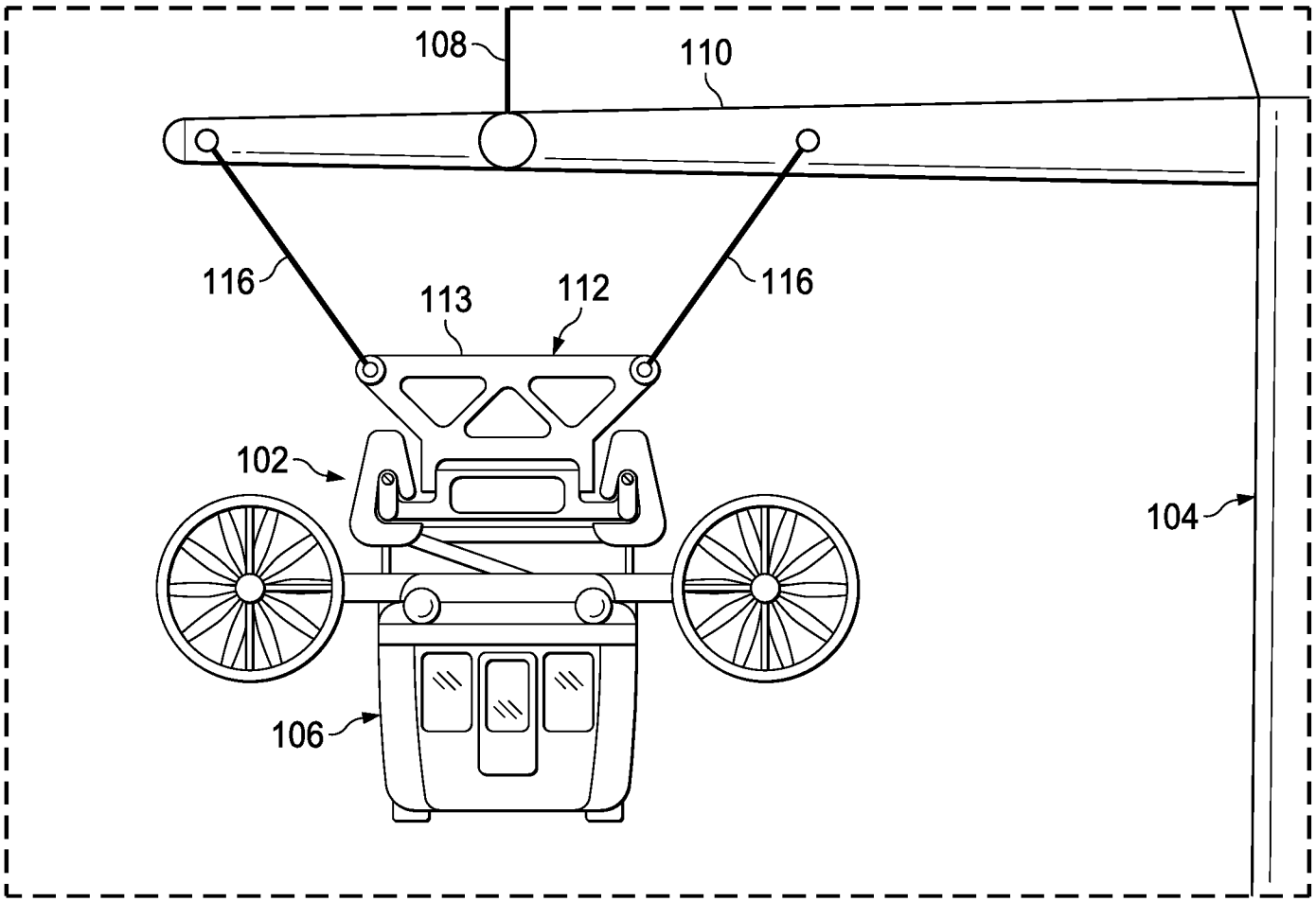
FIG. 3 is a close-up view of a sky tram of the electric aerial sky tram system of FIG. 2.

Referring now to FIGS. 1-3, an electric aerial sky tram system 100 is illustrated, according to aspects of the disclosure. FIG. 1 is a side view of system 100 and FIG. 2 is a front view of system 100. System 100 includes a cable track 102 that is suspended above the ground by a plurality of towers 104. As best seen in FIG. 2, system 100 includes two cable tracks 102 suspended from the plurality of towers 104. Having two cable tracks 102 permits system 100 to operate with sky trams traveling in both directions. As will be appreciated by those having skill in the art, system 100 could be configured with a single cable track 102 if desired. A plurality of sky trams 106 are shown riding along cable track 102 to convey passengers and/or cargo. Each cable track 102 is suspended from each tower 104 by support cables 108 (1)-108(4). In other aspects, more of fewer cable supports 108 may be used as desired.

Each tower 104 includes two lower arms 110 that extend outward from a base 105 of its respective tower 104 and two upper arms 111 that extend upward and outward from base 105 (best seen in FIG. 2). Lower arms 110 extend outward to space cable track 102 from base 105 so that the plurality of sky trams 106 can pass on either side of tower 104 while traveling along cable track 102. Upper arms 111 extend outward and upward from base 105 so that end portions 114 of upper arms 111 are positioned above cable track 102. In some aspects, upper arms 111 may be linked together by a support cable 109. A first end of each support cable 108 is attached to one upper arm 111 of tower 104 and a second end of each support cable 108 is attached to a cable track support 112. In some aspects, a cable track support 112 may be connected to each lower arm 110.

Figure 5:
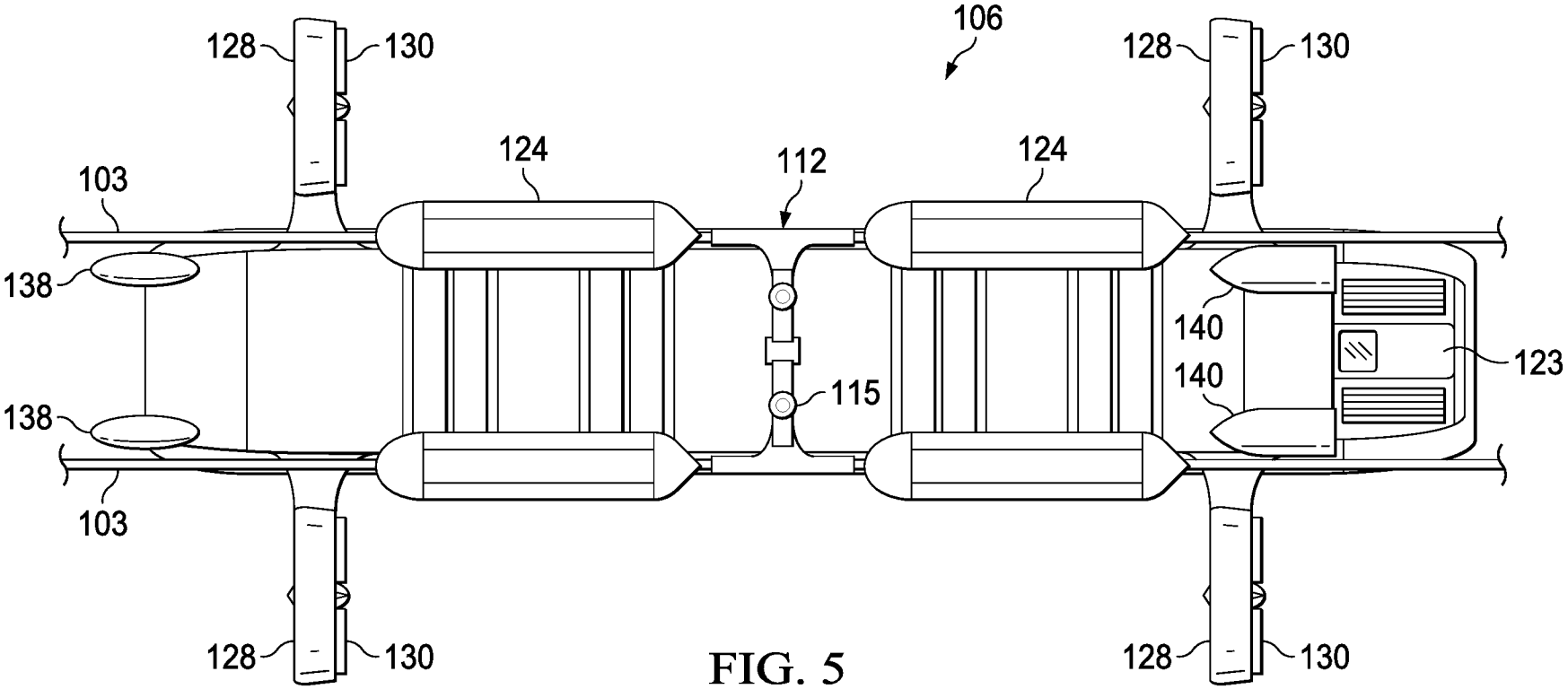
FIG. 5 is a top view of the sky tram of FIG. 4.

Cable track 102 includes two cables 103 that are that supported by a plurality of cable track supports 112 (e.g., see FIGS. 3 and 5). Cable track 102 also acts as a power source for sky tram 106, providing electricity thereto. For example, cable track 102 is electrically coupled to a power station to supply electrical power through cable track 102 to sky tram 106 and other components of system 100. Sky tram 106 receives electrical power from cable track 102 via a conducting element (e.g., an arm or the like made of conductive material that maintains contact with cable track 102). In some aspects, electricity may be carried in a separate wire that that follows the path of cable track 102. For example, cable track support 112 may also support a third wire that carries electricity. Supplying electricity to mass-transit vehicles through wires is a well-known method of powering electric-mass transit vehicles (e.g., subway trains) and will not be discussed in detail.

Figure 7:
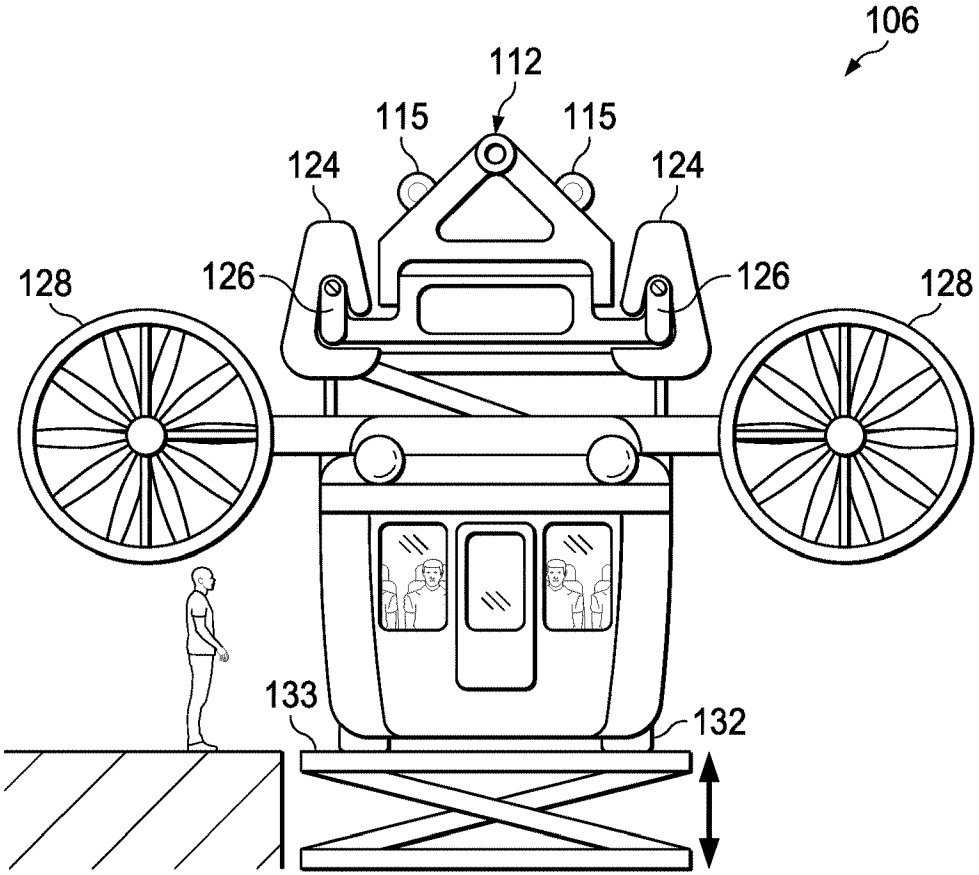
FIG. 7 is a front view of a sky tram resting on a platform, according to aspects of the disclosure.

Cable track 102 is configured similarly to the rails of a railway (e.g., each cable 103 runs parallel to the other cable 103 and a distance therebetween is maintained along the length of cable track 102). Each cable track support 112 is a bracket that secures cables 103 to one another to maintain proper spacing (similar to the function of railroad ties). In some aspects, cable track support 112 includes an attachment bracket 113 that facilitates the attachment of cable track support 112 to support cable 108. FIG. 3 illustrates attachment bracket 113 configured with two support cables 116 that secure cable track support 112 to lower arm 110. FIG. 7 illustrates an attachment bracket 113 configured to receive a single support cable 108. In some aspects, cable track support 112 or attachment bracket 113 include lights 115 (best seen in FIGS. 4, 5, and 7. Lights 115 make cable track 102 more visible (e.g., as a warning to passing aircraft). In some aspects, lights 115 are powered by the electricity that is carried in cable track 102.

Figure 4:
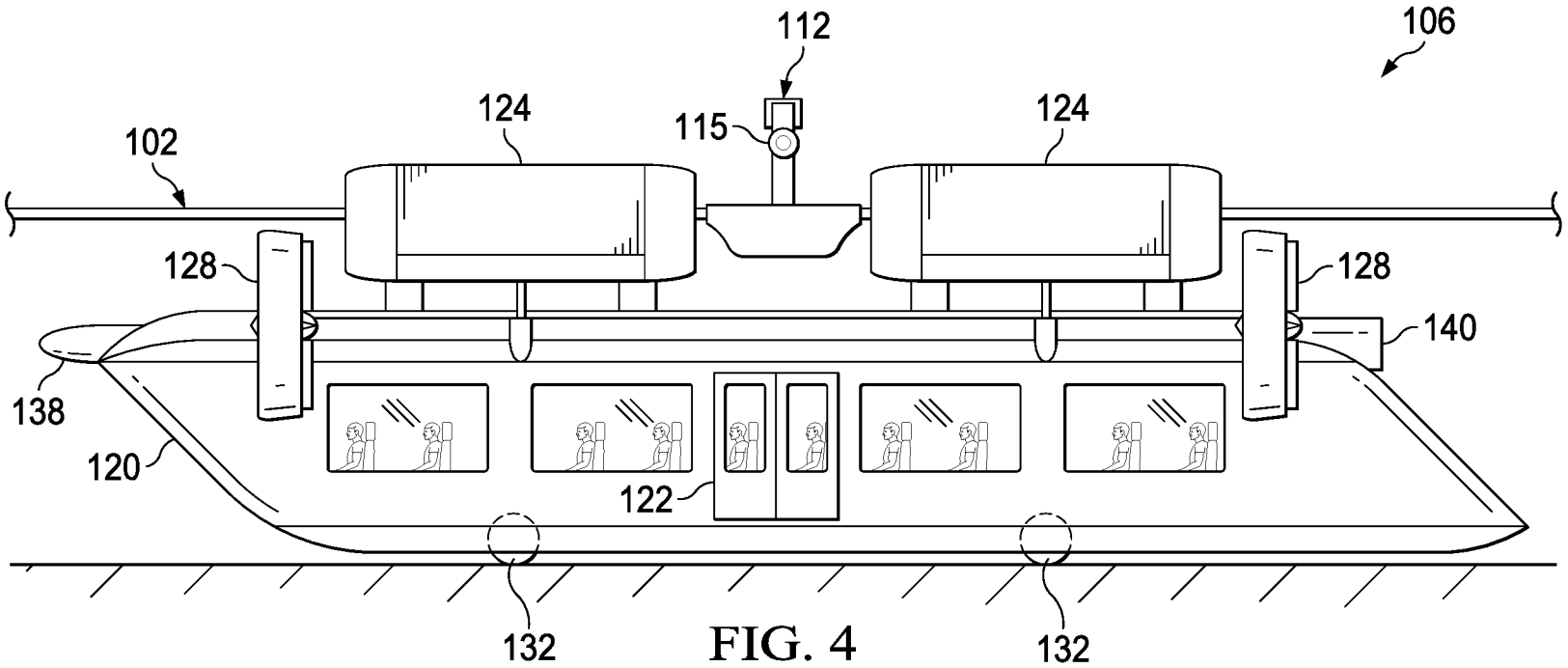
FIG. 4 is a side view of a sky tram, according to aspects of the disclosure.
Figure 6:
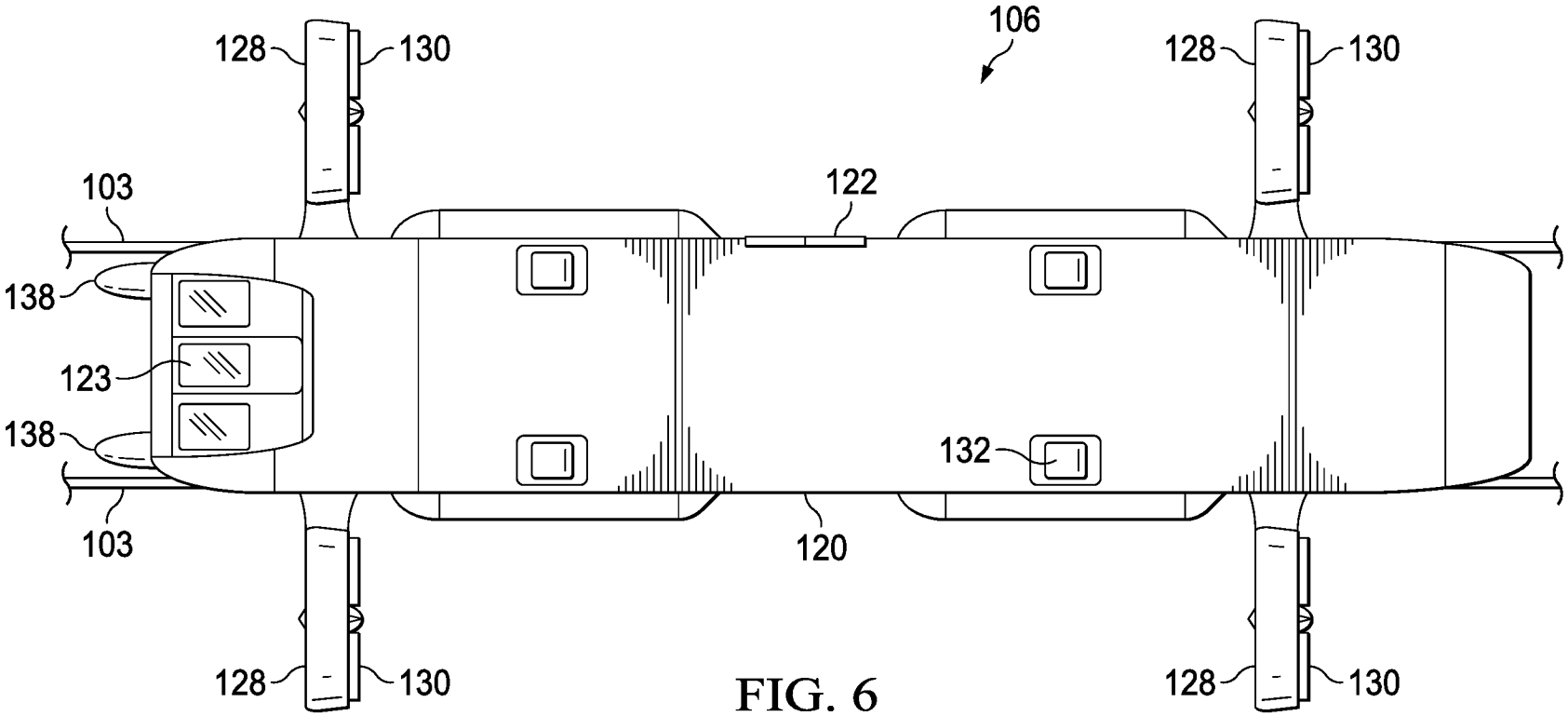
FIG. 6. is a bottom view of the sky tram of FIG. 4.
Figure 8:
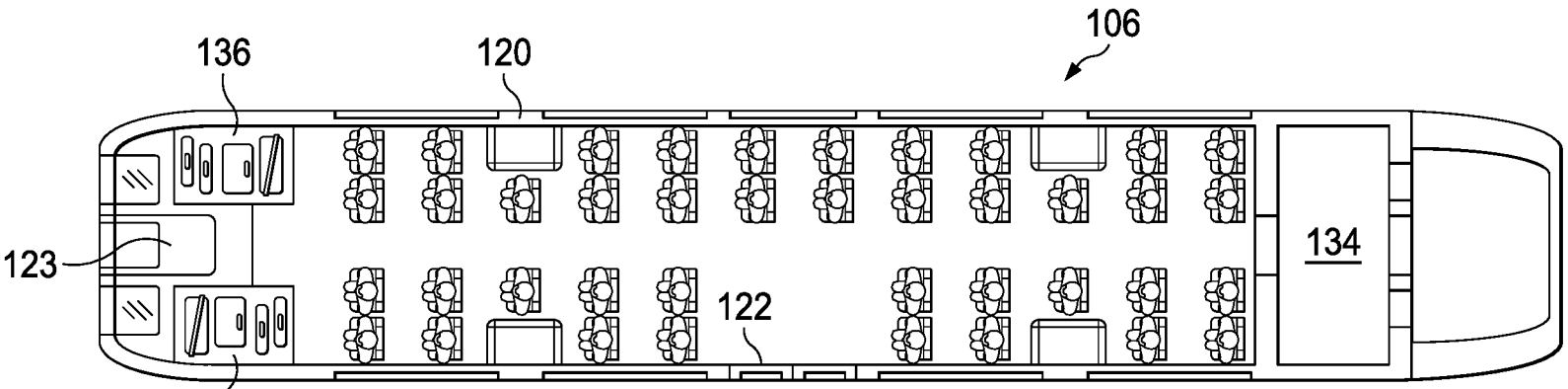
FIG. 8 is a top view of a sky tram, according to aspects of the disclosure.

Referring now to FIGS. 4-8, one sky tram 106 of the plurality of sky trams 106 is illustrated, according to aspects of the disclosure. FIG. 4 is a side view of sky tram 106, FIG. 5 is a top view of sky tram 106, FIG. 6 is a bottom view of sky tram 106, FIG. 7 is a front view of sky tram 106, and FIG. 8 is a top view of sky tram 106 with a roof of sky tram 106 hidden to better show an interior of sky tram 106. Sky tram 106 includes a compartment 120 that may be configured to hold passengers and/or cargo. A set of doors 122 permits ingress/egress to and from compartment 120. As illustrated in FIG. 4, sky tram 106 includes one set of doors 122. In other aspects, sky tram 106 may include additional sets of doors 122 to better facilitate access to compartment 120.

Compartment 120 is secured to cable track 102 via trucks 124. As best seen in FIG. 7, each truck 124 includes two c-channel members 126 that have openings on a side of the c-channel member 126. The openings of the two c-channel members 126 face one another so that the two c-channel members 126 can wrap around cables 103 from the outside of cable track 102. Wrapping around the outside of cable track 102 permits cable track support 112 to pass through trucks 124 as sky tram 106 travels along cable track 102. Each c-channel member 126 includes a plurality of wheels that engage cable 103 that passes therethrough. For example, each c-channel member 126 may include a set of upper wheels that roll on top of cable 103 and a set of lower wheels that roll on a bottom of cable 103. The upper and lower wheels clamp onto cable 103 to secure sky tram 106 thereto. In some aspects, the lower wheels may be biased upward (e.g., via a spring) so that the upper and lower wheels more securely clamp onto cable 103. In some aspects, trucks 124 may include brakes associated with the upper and/or lower wheels to help slow sky tram 106. In some aspects, trucks 124 may include a conducting element that makes an electrical connection with cable 103 to provide power to sky tram 106. The conducting element may be, for example a flexible arm made of conductive material that contacts cable 103.

Sky tram 106 includes a plurality of rotors 128 that provide thrust to propel sky tram 106 along cable track 102. In some aspects, each rotor 128 may be operated in both a forward and backward direction to provide thrust in the forward and backward directions. The plurality of rotors 128 may be operated backward to slow sky tram 106. The plurality of rotors 128 are powered by electric motors that receive electricity from cable track 102, similarly to how electric trains are powered by overhead wires or powered rails. In some aspects, sky tram 106 may include a generator to provide emergency power to sky tram 106. In some aspects, sky tram 106 may include one or more batteries that store electric power for use in the event that cable track 102 loses power.

As illustrated, sky tram 106 includes four rotors 128, with pairs of rotors 128 generally positioned at the front and rear of sky tram 106. In other aspects, more or fewer rotors 128 may be included as desired. Each rotor 128 of the plurality of rotors 128 is illustrated as a ducted fan. As will be appreciated by those having skill in the art, rotors 128 may comprise other types of rotors. Each rotor 128 includes vanes 130 that are configured to control the direction of thrust generated by rotor 128. The operation of the plurality of rotors 128 will be discussed in more detail with regard to FIGS. 12-14 below.

Sky tram 106 includes a plurality of wheels 132 upon which sky tram 106 may rest when passengers and/or cargo are being loaded/unloaded from compartment 120. FIG. 7 illustrates sky tram 106 resting on a platform 133. For example, a sky tram station may include platform 133 for sky tram 106 to roll upon while arriving and departing from the sky tram station. Allowing sky tram 106 to rest upon the plurality of wheels 132 while loading/unloading provides improved stability for sky tram 106 as all or most of the weight of sky tram 106 can be supported by platform 133 instead of cable track 102. In some aspects, platform 133 may raise and lower to meet sky tram 106. For example, sky tram 106 may enter the sky tram station with the entire weight of sky tram 106 being supported by cable track 102. Once sky tram 106 comes to a stop, the platform may be raised from beneath sky tram 106 (e.g., hydraulically, pneumatically, electrically, etc.) to come into contact with the plurality of wheels 132 to bear some or all of the weight of sky tram 106. In some aspects, the plurality of wheels 132 may be replaced with skids (similar to a helicopter's skids). In such aspects, platform 133 may raise up to meet sky tram 106 once sky tram 106 comes to a stop in the sky tram station.

In some aspects, sky tram 106 may be guided into or out of the sky tram station by a capture device. The capture device acts similarly to a tug boat to guide sky tram 106 into and out of the sky tram station. For example, a capture device may be positioned above cable track 102. As sky tram 106 approaches the sky tram station, the capture device interlocks with a receiver (e.g., a hook, a latch, etc.) located on the roof of sky tram 106. The capture device may ride upon cable track 102 or may ride upon its own track or guide system. Once interlocked, the capture device acts as a tug to pull sky tram 106 to the desired position within the sky tram station to load/unload passengers and/or cargo. The capture device may be used to help slow an approaching sky tram 106. In other aspects, the capture device may be located underneath cable track 102 to interlock with a receiver (e.g., a hook, a latch, etc.) located on the underside of sky tram 106. When sky tram 106 is ready to depart, the capture device may be used to help accelerate sky tram 106 away from the sky tram station.

FIG. 8 illustrates a top view of sky tram 106 with a roof of sky tram 106 hidden so than the interior of compartment 120 can be better seen. FIG. 8 illustrates an exemplary seating arrangement that accommodates up to 40 seated passengers with additional room for standing passengers. Compartment 120 also includes an equipment bay 134 and luggage racks 136. Equipment bay 134 may house various components of sky tram 106, such as, for example, heating and air conditioning equipment, electronics equipment and controllers that control the operation of sky tram 106, and the like. As will be appreciated by those having skill in the art, compartment 120 may be differently configured as desired. Additionally, the dimensions of compartment 120 and sky tram 106 may be altered to better suit particular uses.

Figure 9A:
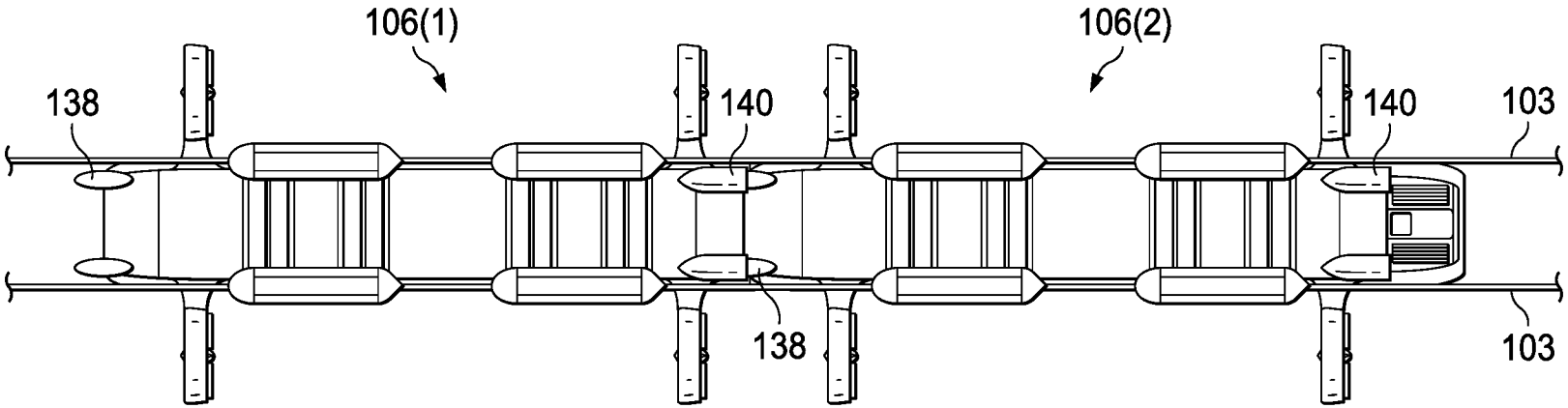
FIGS. 9A and 9B are top and side views, respectively, of two sky trams in a docked configuration, according to aspects of the disclosure.
Figure 9B:
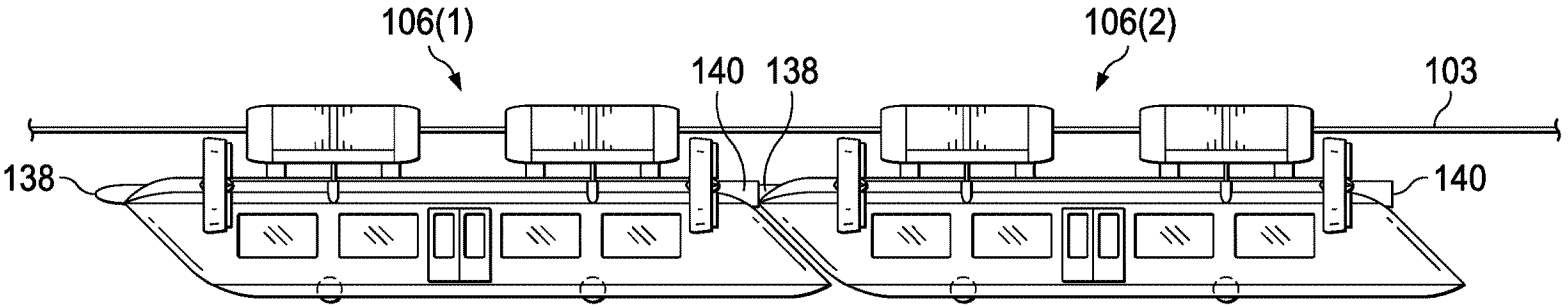

Referring now to FIGS. 9A and 9B, top and side views, respectively, of two sky trams 106(1), 106(2) in a docked configuration are illustrated, according to aspects of the disclosure. Each sky tram 106 is configured to be able to dock to an adjacent sky tram 106 or other service vehicles traveling on cable track 102. Docking sky trams 106 together can be helpful to perform maintenance or to remove passengers from a disabled sky tram. To enable docking, each sky tram 106 includes a pair of probes 138 and a pair of docks 140. The pair of probes 138 are disposed on a first end of sky tram 106 and the pair of docks 140 are disposed on the opposite end of sky tram 106. In some aspects, sky tram 106 includes a single probe 138 and a single dock 140.

As illustrated in FIGS. 9A and 9B, the pair of probes 138 are located at the front of sky tram 106 and the pair of docks 140 are located at the rear of sky tram 106. In other aspects, the position of the pair of probes 138 and the pair of docks 140 could be reversed. Two sky trams 106 can dock together by moving the sky trams together so that the pair of probes 138 of one of the sky trams 106 engage the pair of docks 140 of the other sky tram 106. The pair of docks 140 are configured to latch onto the pair of probes 138 to secure the two sky trams together. For example, if sky tram 106(1) becomes disabled, a second sky tram 106(2) may approach sky tram 106(1) and dock with it. The pair of probes 138 and the pair of docks 140 may couple together using latches, hooks, electromagnetic forces, pins, and the like. The arrangement of the pair of probes 138 and the pair of docks 140 enables any sky tram 106 to be docked with another sky tram 106 from either end. Each sky tram 106 includes a set of doors 123 at the front and the rear of the sky tram (e.g., see FIGS. 5-8). Once docked, doors 123 of the two sky trams 106 that are located at adjacently facing ends of each sky tram 106 may open to permit passengers and/or maintenance workers to pass between the docked sky trams 106.

Figure 10:
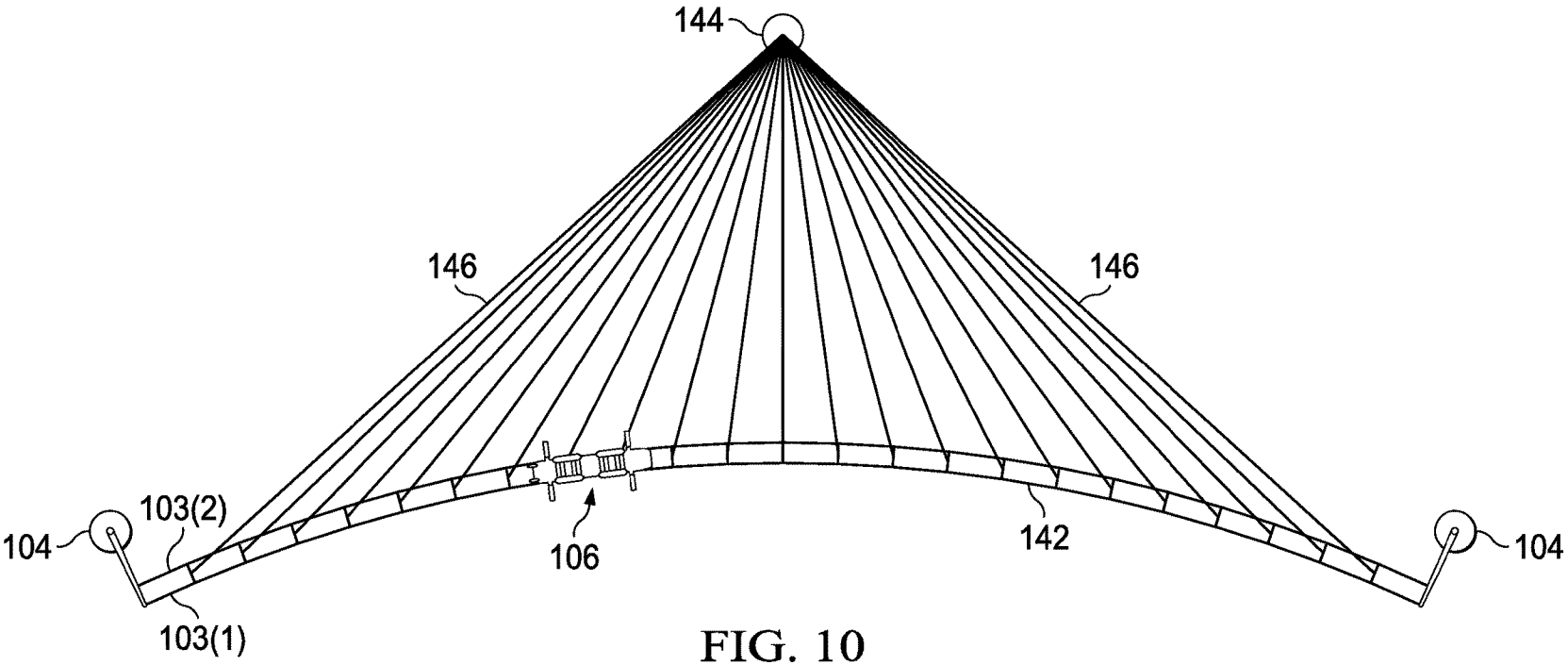
FIG. 10 is a top view of a curved track for an electric aerial sky tram system, according to aspects of the disclosure.

FIG. 10 illustrates a top view of a tower arrangement that enables cable track 102 to form a curved path, according to aspects of the disclosure. In contrast to aerial sky trams, which can only travel in straight lines between adjacent towers, system 100 can be configured to include curves. FIG. 10 illustrates a curved portion 142 of cable track 102 that includes two towers 104 and a turn tower 144 placed outside the curved portion 142. When viewed from above, as illustrated in FIG. 10, turn tower 144 forms a triangle with two towers 104. Turn tower 144 is coupled to cable track 102 by a plurality of support cables 146. Each cable support connects at a first end to turn tower 144 and at a second end to its own cable track support 112. In contrast to support cables 108, which extend from towers 104 in the X-Y plane (e.g., similar to the cables of a suspension bridge), support cables 146 extend from turn tower 144 with X, Y, and Z components. To create a curve in cable track 102, turn tower 144 is positioned at a horizontal distance from cable track 102 that is greater than a horizontal distance between towers 104 and cable track 102. Cables 146 are tensioned to pull cable track 102 into the curved shape illustrated in FIG. 10. The number of support cables 146 used varies based upon the desired length of the curved portion 142 and the desired smoothness of cable track 102. The greater the length of curved portion 142, the greater the number of support cables 146 needed. Smoothness of cable track 102 increases as the number of support cables 146 increases (e.g., similar to approximating the curve of a circle via many small linear segments). In some aspects, cable track supports 112 of the curved portion 142 may be joined together via linkages to form a frame in the shape of the desired curve (similar to roller coaster track). Joining the cable track supports 112 together can help to create a smoother track for sky tram 106.

In the aspect illustrated in FIG. 10, a single turn tower 144 is illustrated. It will be appreciated by those having skill in the art that multiple turn towers 144 could be used to divide the load between towers and/or to facilitate longer curves. In some aspects, additional support for cable track 102 could be provided by placing an additional turn tower 144 on the inside of curved portion 142. In some aspects, the portion of cable track 102 that forms the curved portion 142 may be angled so that cable 103(1) that is located on an inside of the turn is at a lower height than cable 103(2) located on an outside of the turn. Angling cable track 102 in this way will make the ride more comfortable for passengers as the feeling of centrifugal force is somewhat mitigated. In other aspects, cable track 102 is kept level with the horizon and sky tram 106 is articulated to lean into the turn. This aspect is discussed in more detail below relative to FIGS. 16-18.

Figure 11:
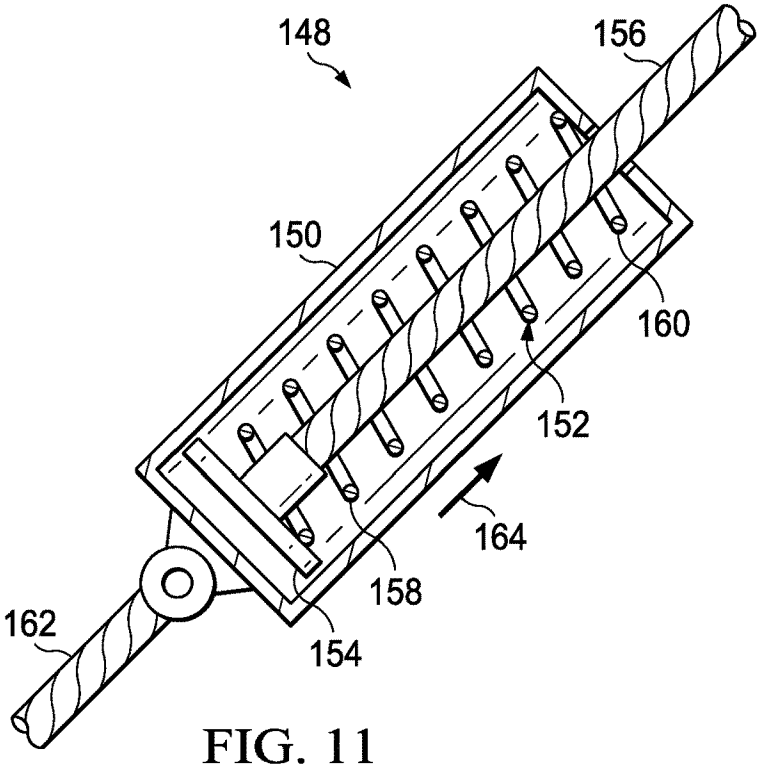
FIG. 11 is a sectioned view of a cable dampener for an electric aerial sky tram system, according to aspects of the disclosure.

FIG. 11 illustrates a sectioned view of a cable dampener 148 for use with support cables, according to aspects of the disclosure. For example, cable dampener 148 may be used with support cables 108, 116, and/or 146. Cable dampener 148 is used to allow cable track 102 to rise and fall in response to the weight of sky tram 106. For example, as sky tram 106 travels along cable track 102, the weight of sky tram 106 causes cable track 102 to deflect downward. The deflection of cable track 102 is at a maximum between two adjacent support cables. To mitigate some of the up and down motion of sky tram 106 as it travels between adjacent support cables 108, and to mitigate any sharp bumps experienced by passing over portions of cable track 102 close to tower 104, cable dampener 148 allows cable track 102 to deflect downward as sky tram 106 passes.

Cable dampener 148 includes a dampener body 150 that houses an elastic element 152 (e.g., a spring, a hydraulic element, pneumatic element, etc.) therein. In FIG. 11, elastic element 152 is illustrated as a helical spring. An end 154 of a support cable 156 is engaged with a first end 158 of elastic element 152. The opposite end of support cable 156 is attached to a tower (e.g., tower 104, 144). A second end 160 of elastic element 152 bears against dampener body 150 to bias support cable 156 as shown in FIG. 11. Dampener body 150 is also connected to a support cable 162 that is connected to cable track 102. When sky tram 106 is not proximate to cable dampener 148, elastic element 152 is expanded as illustrated in FIG. 11. When sky tram 106 is proximate to cable dampener 148, the weight of sky tram 106 acting upon cable track 102 acts against elastic element 152 and end 154 of support cable 156 is displaced in the direction of arrow 164 to allow cable track 102 some flexibility to smooth out the ride of sky tram 106 passing thereover.

Figure 12B:
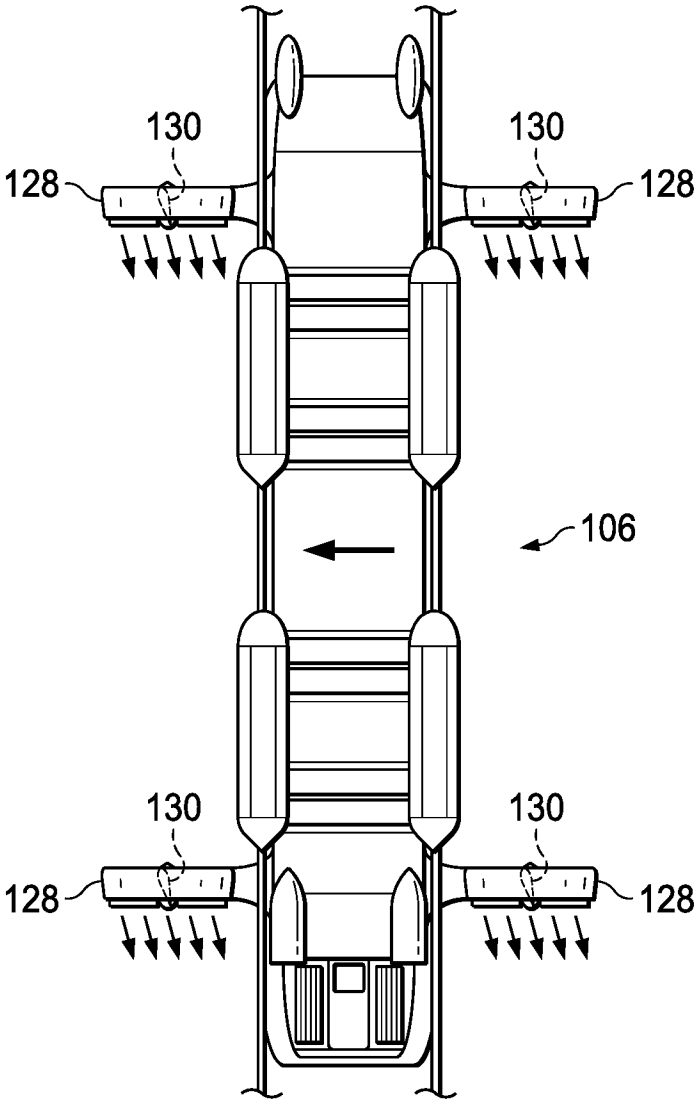
FIGS. 12A and 12B illustrate lateral translation of a sky tram, according to aspects of the disclosure.
Figure 12A:
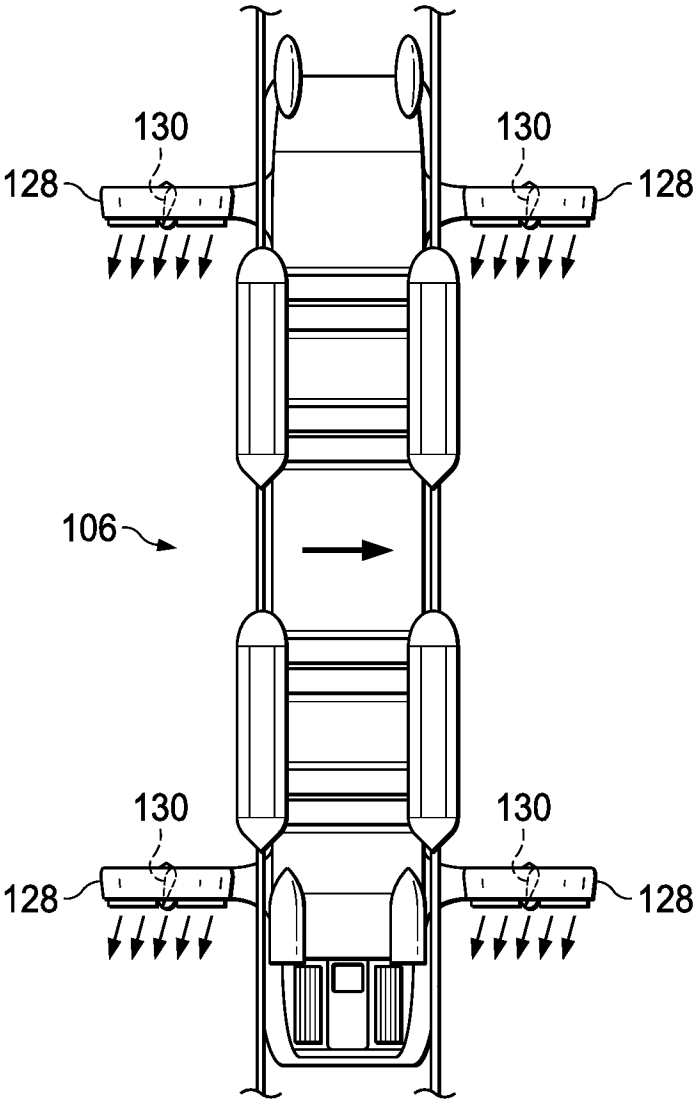
Figure 13B:
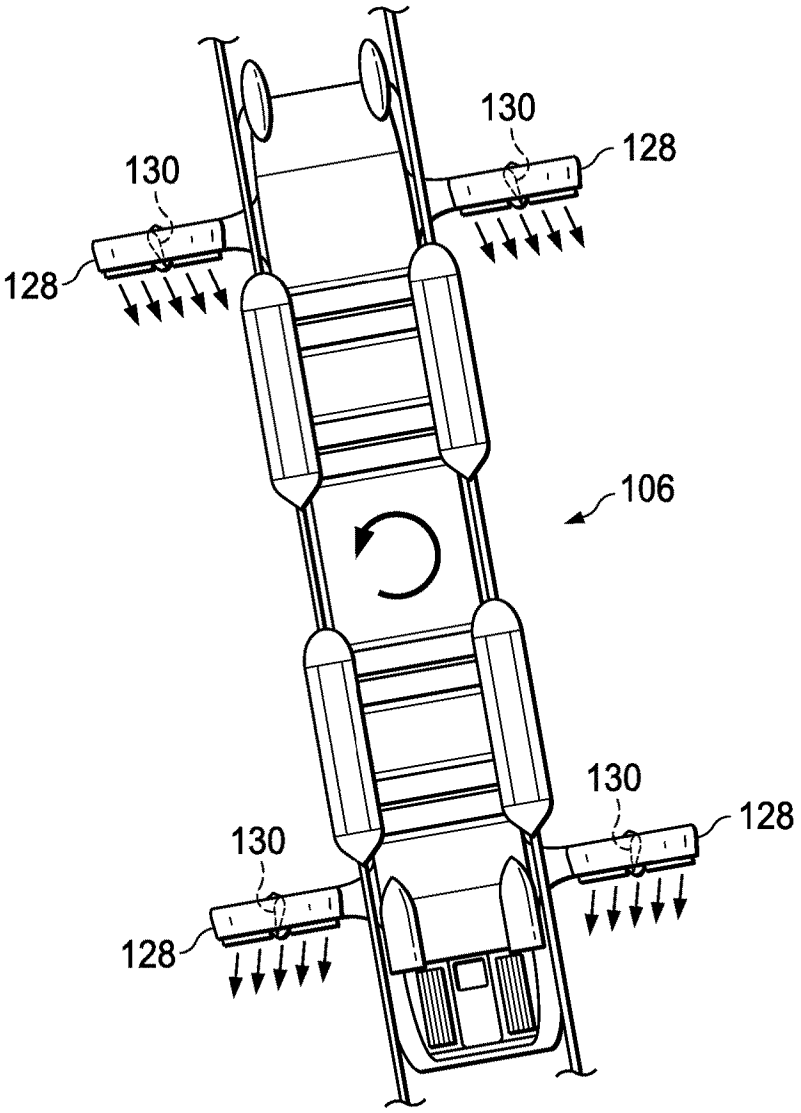
FIGS. 13A and 13B illustrate yaw of a sky tram, according to aspects of the disclosure.
Figure 13A:
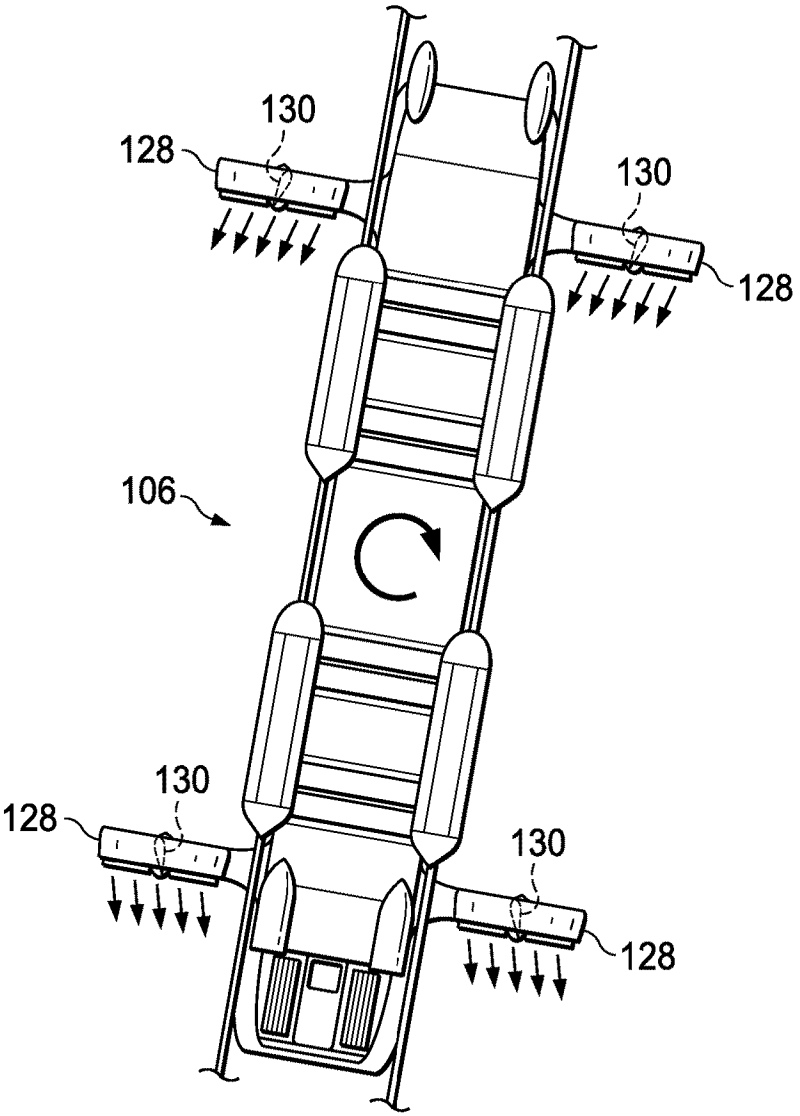
Figure 14A:
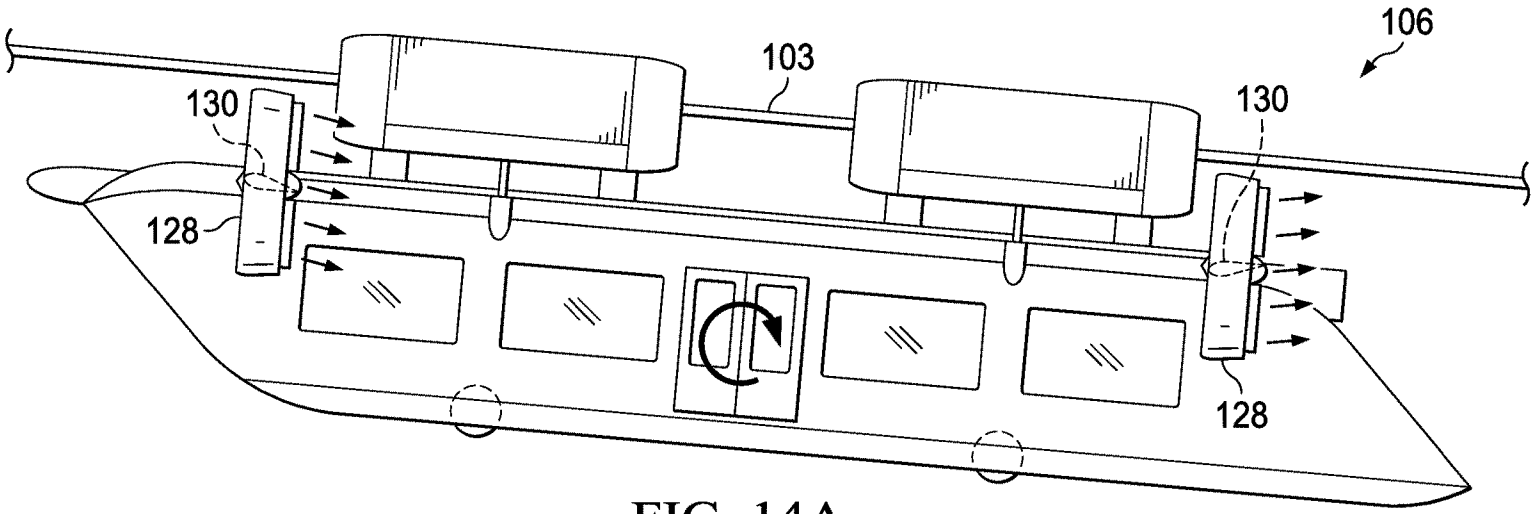
FIGS. 14A and 14B illustrate pitch of a sky tram, according to aspects of the disclosure.
Figure 14B:
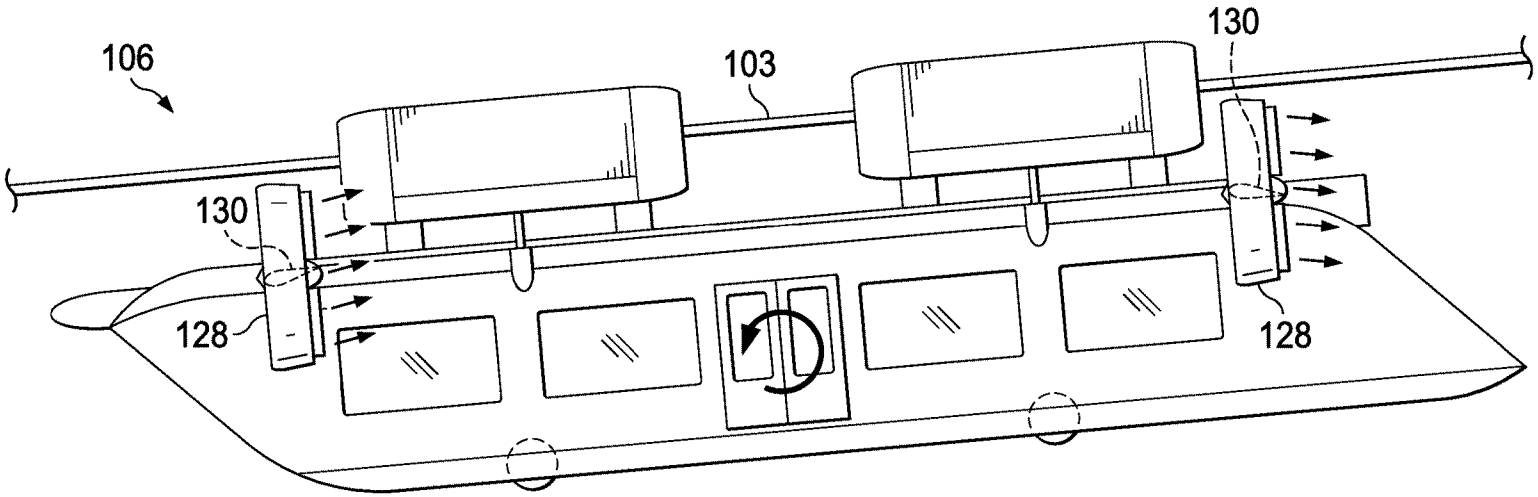

Referring now to FIGS. 12-14, an ability of sky tram 106 to adjust its orientation via the plurality of rotors 128 is illustrated. Each rotor 128 includes vanes 130 that allow a direction of the thrust generated by the rotor 128 to be controlled. Each rotor 128 includes at least one vertically oriented vane 130 and at least one horizontally oriented vane 130. Each vane 130 is linked to an actuator controlled by an on-board computer and is configured to articulate up to +/−25°. FIGS. 12A and 12B illustrate using vertically oriented vanes 130 of each rotor 128 to induce a lateral thrust component in the starboard and port directions, respectively. FIGS. 13A and 13B illustrate using vertically oriented vanes 130 of each rotor 128 to induce yaw in the clockwise and counterclockwise directions. FIGS. 14A and 14B illustrate using the horizontally oriented vanes 130 of each rotor 128 to induce pitch up and pitch down, respectively.

One of ordinary skill in the art will recognize that the articulation of the horizontally and vertically oriented vanes 130 of rotors 128 can be used in combination to adjust the orientation of sky tram 106 in a variety of ways. The ability to articulate the orientation of sky tram 106 can be helpful when operating sky tram 106 in windy or bad weather conditions. For example, when presented with a cross-wind, vanes 130 can be used to generate thrust that not only propels sky tram 106 along cable track 102, but also counteracts the effects of the cross-wind. Compared to conventional trains and aerial trams, sky tram 106 is uniquely able to operate in a variety of wind and weather conditions while maintaining superior stability, even at high speeds of up to 160 MPH. In some aspects, sky tram 106 may be fitted with winglets and other control surfaces (e.g., flaps, ailerons, and the like) to prove additional aerodynamic control of sky tram 106.

Referring now to FIGS. 15-17, a mechanical orientation system 170 for use with sky tram 106 is illustrated, according to aspects of the disclosure. Mechanical orientation system 170 includes a plurality of actuators 172 coupled between compartment 120 and trucks 124. The plurality of actuators 172 are controlled by a controller that is onboard sky tram 106. In some aspects, the controller monitors the orientation of sky tram 106 and adjusts the lengths the plurality of actuators 172 to adjust the orientation of sky tram 106. For example, if a crosswind is present, the controller may monitor one or more sensors (accelerometers etc.) to monitor the orientation of sky tram 106. If a crosswind is present, the orientation of sky tram 106 will be altered compared to when no crosswind is present. The controller may then actuate vanes 130 to reorient sky tram 106 into the desired orientation.

Figure 15A:
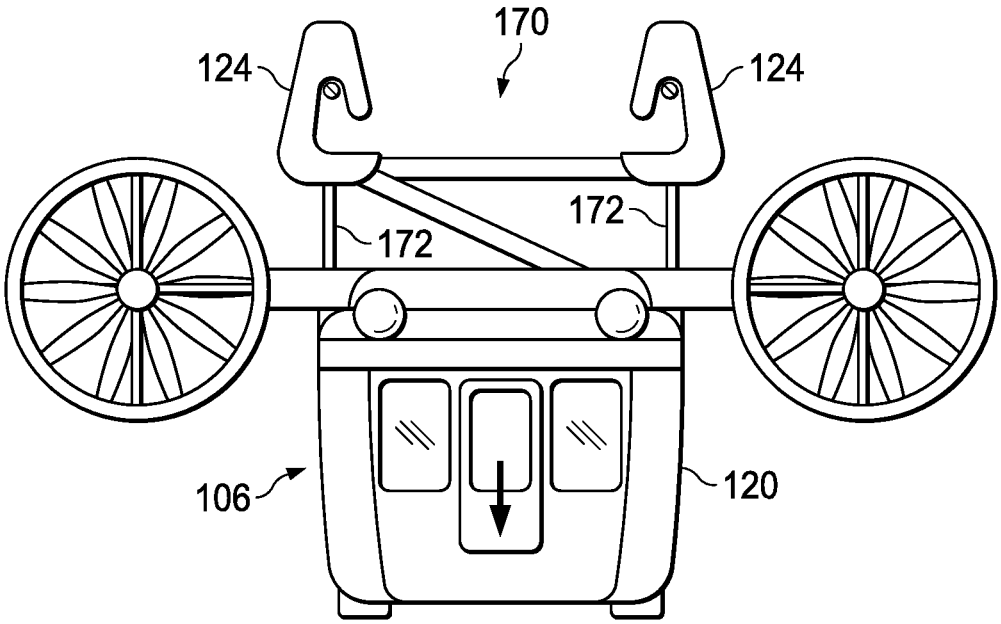
FIGS. 15A, 15B, 16A, 16B, 17A, and 17B illustrate a mechanical orientation system for a sky tram, according to aspects of the disclosure.
Figure 15B:
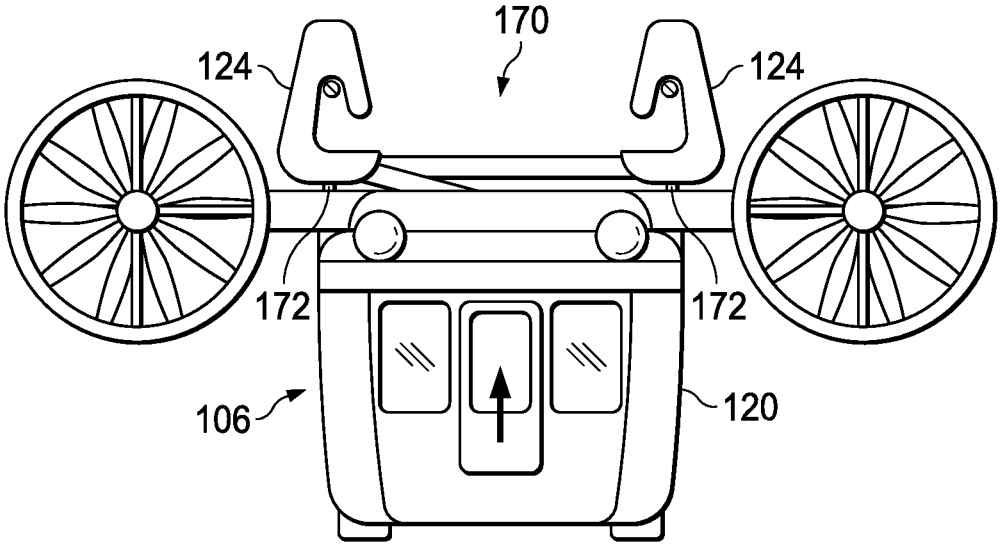
Figure 16A:
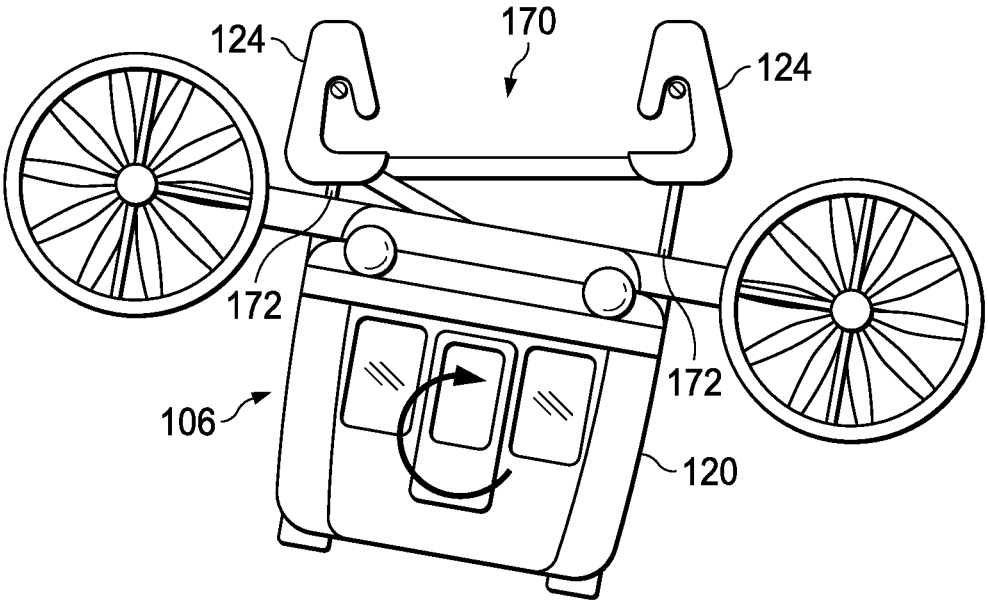
Figure 16B:
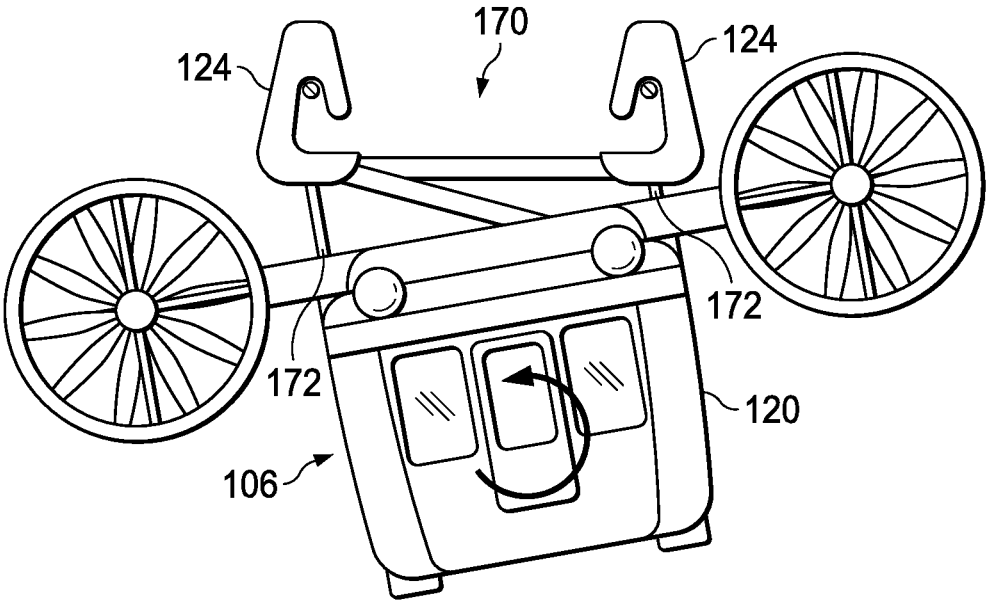
Figure 17A:
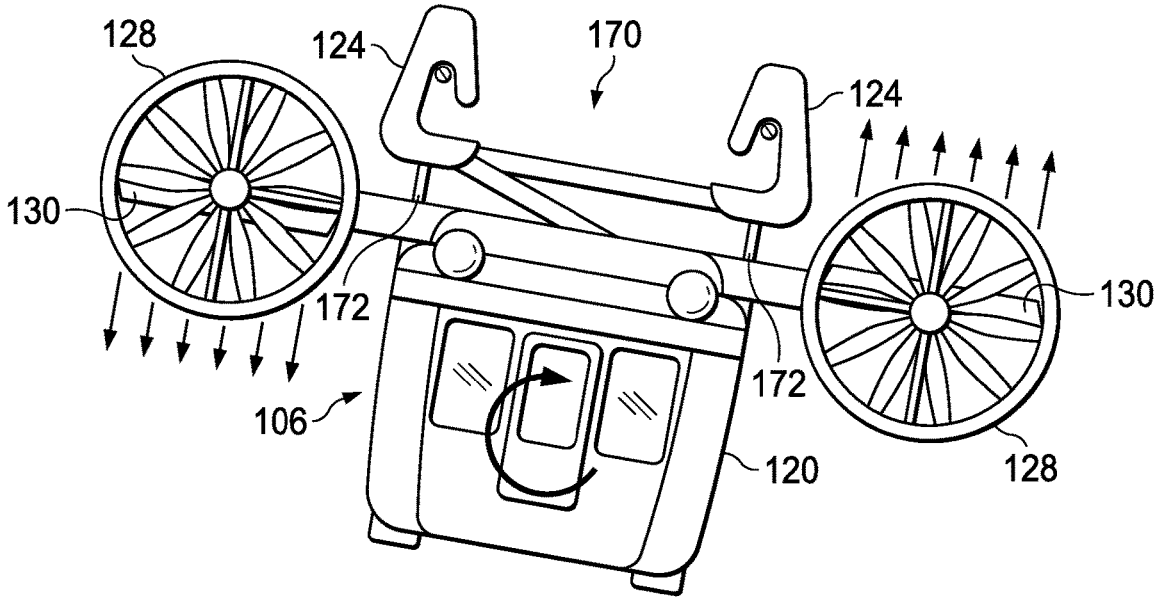
Figure 17B:
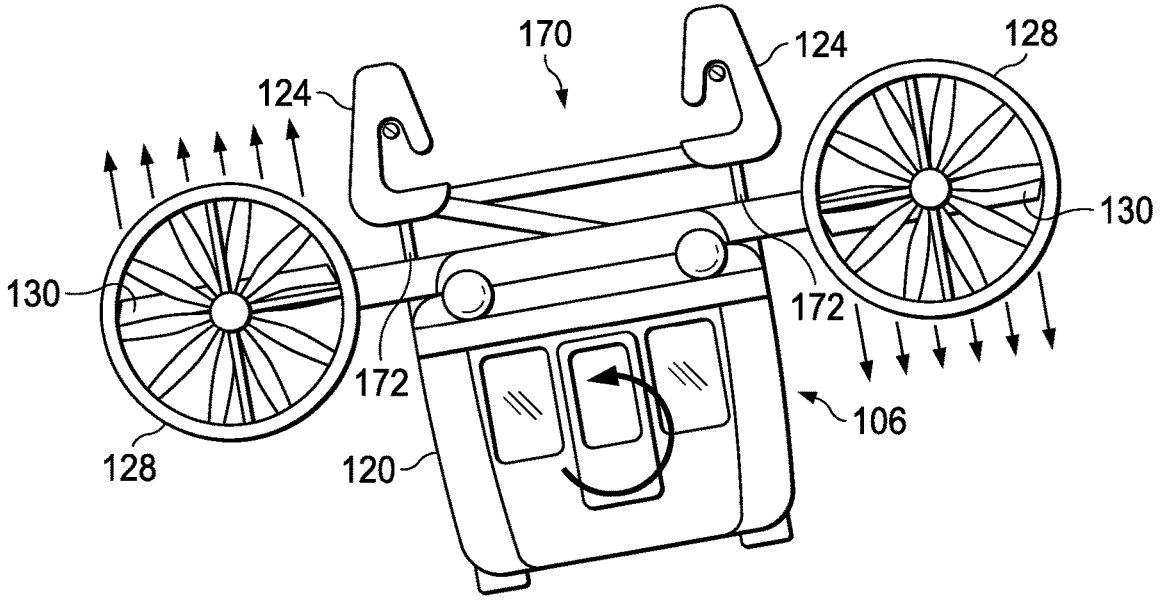

The plurality of actuators 172 may be, for example, hydraulic actuators, pneumatic actuators, or electromechanical actuators that are configured to raise, lower, and/or roll sky tram 106 by extending and retracting as illustrated. FIGS. 15A and 15B illustrate the plurality of actuators 172 being used to lower and raise sky tram 106, respectively. FIGS. 16A and 16B illustrate the plurality of actuators 172 being used to roll sky tram 106 in the clockwise and counterclockwise directions, respectively (e.g., to lean into a turn to counter g-forces of a turn). FIGS. 17A and 17B, illustrate the plurality of actuators 172 being used in combination with vanes 130 of rotors 128 to roll sky tram 106 in the clockwise and counterclockwise directions, respectively (e.g., to counter g-forces of a turn).

Figure 18A:
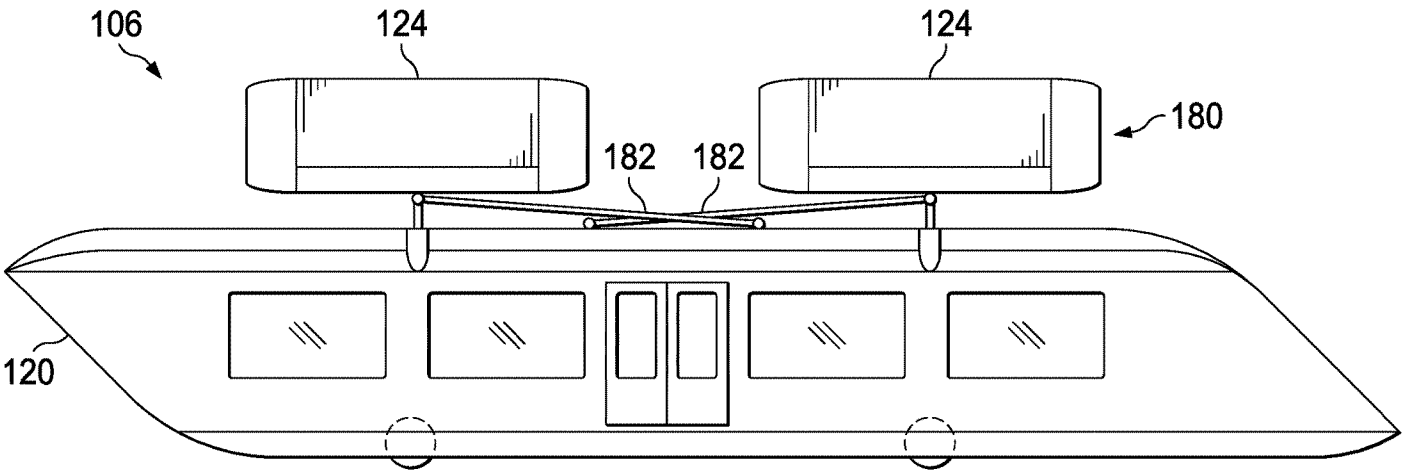
FIGS. 18A-18D illustrate a mechanical orientation system for a sky tram, according to aspects of the disclosure.
Figure 18B:
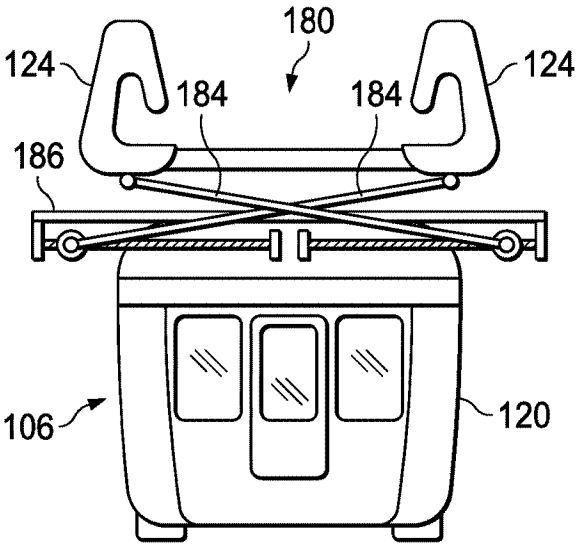
Figure 18D:
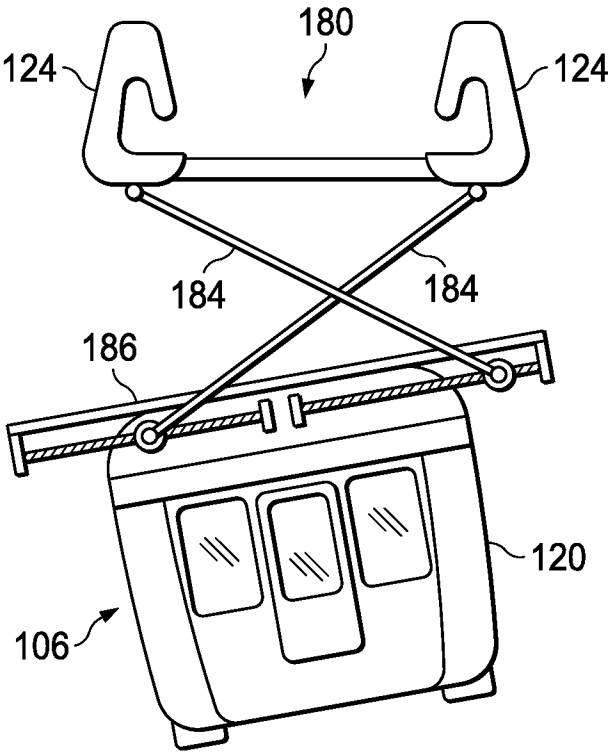
Figure 18C:
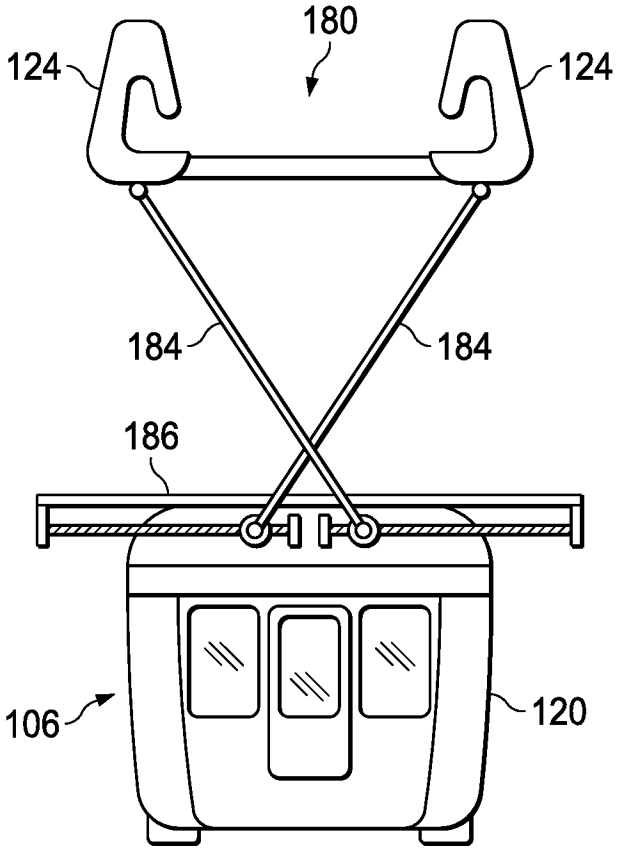

Referring now to FIGS. 18A-18D, a mechanical orientation system 180 for use with sky tram 106 is illustrated, according to aspects of the disclosure. Mechanical orientation system 180 includes a first plurality of linkages 182 and a second plurality of linkages 184. In contrast to the plurality of actuators 172 that have adjustable lengths, the first and second plurality of linkages 182, 184 are fixed in length. The first plurality of linkages 182 are arranged generally in the direction of a length of sky tram 106, with a first end of each linkage 182 attached to one truck 124 and a second end of each linkage 182 slidably attached to the top of compartment 120. The second ends of linkages 182 are slidably attached to the top of compartment 120 to permit movement of the second plurality of linkages 184 while still providing some support for sky tram 106. The second plurality of linkages 184 are arranged generally in the direction of a width of sky tram 106, with a first end of each linkage 184 attached to one truck 124 and a second end of each linkage 184 movably attached to a track 186. Track 186 allows the second end of each linkage 184 to travel along the track to change the orientation of sky tram 106. In some aspects, track 186 and linkages 184 use a ball-screw arrangement to move linkages 184 along track 186. In such embodiments, track 186 is a threaded rod upon which a ball nut of the second end of linkage 184 rides. In some aspects, track 186 is a rack with teeth that mesh with teeth of a rolling gear on the second end of linkage 184. In the aspects illustrated in FIGS. 18B-18D, track 186 includes two separate tracks for each linkage 184 connected thereto. In other aspects, track 186 may be a single track to which both linkages 184 are connected. FIG. 18B illustrates sky tram 106 in a raised position with linkages 184 positioned at outer extremities of track 186. FIG. 18C illustrates sky tram 106 in a lowered position with linkages 184 positioned at inner extremities of track 186. FIG. 18D illustrates sky tram 106 in a leaned position (e.g., to counter g-forces of a turn).

In the aspect shown in FIGS. 18A-18D, sky tram 106 includes two sets of linkages 184, with a first set toward a front of sky tram 106 and a second set toward a rear of sky tram 106. In other aspects, sky tram 106 may include additional sets of second linkages 184 as desired.

The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed aspect, the terms "substantially," "approximately," "generally," and "about" may be substituted with "within [a percentage] of" what is specified, where the percentage includes 0.1, 1, 5, and 10 percent.

The foregoing outlines features of several aspects so that those skilled in the art may better understand the aspects of the disclosure. Those skilled in the art should appreciate that they may readily use the disclosure as a basis for designing or modifying other processes and structures for carrying out the same purposes and/or achieving the same advantages of the aspects introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. An aerial sky tram system comprising:

a plurality of towers;

a cable track suspended from the plurality of towers by a support cable;

a sky tram coupled to the cable track, the sky tram comprising a plurality of rotors that propel the sky tram along the cable track; and wherein:

the cable track comprises a curved portion;

the plurality of towers comprises a first tower, a second tower, and a turn tower positioned between the first and second towers; and a horizontal distance between the turn tower and the cable track is greater than a horizontal distance between the first tower and the cable track.

2. The aerial sky tram system of claim 1, wherein each rotor of the plurality of rotors comprises a vertically oriented vane and a horizontally oriented vane that articulate to control a direction of thrust generated by the rotor.

3. The aerial sky tram system of claim 1, wherein the sky tram comprises a probe attached to a first end of the sky tram and a dock attached to a second end of the sky tram.

4. The aerial sky tram system of claim 1, wherein the cable track comprises two cables coupled together in parallel by a cable track support suspended from a tower of the plurality of towers.

5. The aerial sky tram system of claim 4, wherein the cable track support comprises an attachment bracket that couples the support cable to the cable track.

6. The aerial sky tram system of claim 4, wherein the plurality of towers comprises:

a tower comprising an upper arm that extends vertically and horizontally from a base of the tower; and wherein a first end of the support cable is attached to the upper arm and a second end of the support cable is attached to the cable track support.

7. The aerial sky tram system of claim 4, wherein at least one cable of the two cables carries electricity to power the plurality of rotors.

8. The aerial sky tram system of claim 1, wherein the sky tram comprises a truck attached to a top of the sky tram and coupled to the cable track.

9. The aerial sky tram system of claim 8, wherein the truck comprises a pair of c-channel members, each c-channel member of the pair of c-channel members comprising an opening that faces the opening of the other c-channel member of the pair of c-channel members.

10. The aerial sky tram system of claim 8, wherein the sky tram comprises a mechanical orientation system configured to raise, lower, and roll the sky tram.

11. The aerial sky tram system of claim 10, wherein the mechanical orientation system comprises a plurality of actuators coupled between the truck and a compartment of the sky tram.

12. The aerial sky tram system of claim 10, wherein:

the mechanical orientation system comprises a plurality of linkages coupled between the truck and a compartment of the sky tram; and the linkages have a fixed length.

13. An aerial sky tram system comprising:

a plurality of towers;

a cable track suspended from the plurality of towers by a support cable comprising a cable dampener;

a sky tram coupled to the cable track, the sky tram comprising a plurality of rotors that propel the sky tram along the cable track; and wherein the cable dampener comprises:

a cable dampener body;

an elastic element disposed within the cable dampener body; and wherein an end of the support cable is coupled to the elastic element and the cable dampener body is coupled to a cable track support of the cable track.

14. The aerial sky tram system of claim 13, wherein each rotor of the plurality of rotors comprises a vertically oriented vane and a horizontally oriented vane that articulate to control a direction of thrust generated by the rotor.

15. The aerial sky tram system of claim 13, wherein the sky tram comprises a probe attached to a first end of the sky tram and a dock attached to a second end of the sky tram.

16. The aerial sky tram system of claim 13, wherein the cable track comprises two cables coupled together in parallel by a cable track support suspended from a tower of the plurality of towers.

17. The aerial sky tram system of claim 16, wherein the cable track support comprises an attachment bracket that couples the support cable to the cable track.

18. The aerial sky tram system of claim 16, wherein the plurality of towers comprises:

a tower comprising an upper arm that extends vertically and horizontally from a base of the tower; and wherein a first end of the support cable is attached to the upper arm and a second end of the support cable is attached to the cable track support.

19. A sky tram for an aerial sky tram system, the sky tram comprising:

a compartment;

a truck attached to a top of the compartment and configured to couple to the sky tram to a cable track suspended from a tower;

a plurality of ducted fans attached to the compartment and configured to propel the sky tram along the cable track; and wherein each ducted fan of the plurality of ducted fans comprises:

a duct housing a plurality of rotor blades; and a vertically oriented vane and a horizontally oriented vane aft of the plurality of rotor blades and that articulate to control a direction of thrust generated by the rotor.

20. The sky tram of claim 19, wherein the sky tram comprises a mechanical orientation system configured to raise, lower, and roll the sky tram.

* * * * *